US005482389A

United States Patent [19]

Bickoff et al.

[11] Patent Number: 5,482,389

[45] Date of Patent: Jan. 9, 1996

[54] PAPER FEED DRIVEN CUTTER MECHANISM OF AN ELECTRONIC PRINTER

[75] Inventors: Charles Bickoff, Sharon; Dominic P. Emello, Belmont, both of Mass.

[73] Assignee: Westerex International, division of Capitol Circuits, Boston, Mass.

[21] Appl. No.: 344,864

[22] Filed: Nov. 25, 1994

[51] Int. Cl.[6] ..... B41J 11/66; B41J 11/70

[52] U.S. Cl. ..... 400/621; 400/593; 101/93.07; 83/563

[58] Field of Search ..... 400/621, 593; 101/93.07; 83/563, 564, 589, 597, 600, 602, 879, 365

[56] References Cited

U.S. PATENT DOCUMENTS

| | | | |
|---|---|---|---|
| 4,149,458 | 4/1979 | Clary | 101/93.07 |
| 4,211,498 | 7/1980 | Shimizu et al. | 400/621 |
| 4,357,116 | 11/1982 | Oguchi | 400/621 |
| 4,982,636 | 1/1991 | Becking | 83/167 |
| 5,041,845 | 8/1991 | Ohkubu et al. | 400/621 |
| 5,279,195 | 1/1994 | Breton | 83/72 |
| 5,397,190 | 3/1995 | Iida | 400/593 |

*Primary Examiner*—Ren Yan
*Assistant Examiner*—Lynn D. Hendrickson
*Attorney, Agent, or Firm*—Charles Bickoff

[57] ABSTRACT

A paper cutting device of an electronic printer which derives its motive power from the drive source operating the paper feed mechanism of the printer. The paper feed mechanism has a one-way clutch coupled to the paper feed drive shaft which locks on to the shaft when feeding print media in the forward direction and over runs when the paper feed drive source rotates opposed to the print media driving direction. A second one-way clutch is coupled to the cutter drive shaft and positively engages the cutter mechanism when the paper feed drive is operated in the reverse non-feeding direction. It over runs when print media is being fed. The cutting mechanism is driven through its one-way clutch to a couple eccentric crank. The crank pushes a linear guided cutter blade by means of an articulated link which engages the blade. The paper is registered against the front edge of a slot in the blade guide and the blade is forced through the restrained media. The blade is then positively retracted and its home position is sensed by an optical sensor which signals the control electronics that the cutting cycle has been completed. The home position is detented to allow the cutting mechanism to be opened without loosing its home reference position.

11 Claims, 6 Drawing Sheets

PAPER FEED DRIVEN CUTTER MECHANISM OF AN ELECTRONIC PRINTER

BACKGROUND

1. Field of the Invention

The invention herein described relates to a novel paper cutting mechanism of an electronic printing device with the reverse motion of the paper feed mechanism operating the cutting mechanism. In particular, this machine offers several advantages over the prior an in terms of simplicity, economy of design, maintainability, and reliability. Prior machines have often used complex linkages, expensive cutting blades, separate motor, active enabling sources, require precision components and/or assembly, were difficult to maintain, had long strokes thereby limiting their cutting width, or requiring high power.

Additionally, the invention herein disclosed, is equally applicable to a variety of electronic printing technologies. These include but are not limited to thermal, thermal transfer, dot matrix, and ink jet technologies. It is common in these technologies to move the paper with a stepping motor power source. Motors of this type have the ability to rotate in both the clockwise and counterclockwise directions. In most applications it is only necessary to feed print media in the forward direction, thereby freeing the opposite direction of rotation for powering other devices such as a paper cutting mechanism. The present invention takes advantage of unidirectional paper motion and uses the counter-rotating motion to power the cutting mechanism through a pair of one-way clutches such as those manufactured by The Torrington Company of Torrington, Conn.

2. Prior Art

U.S. Pat. No. 4,211,498, invented by Munetaka Shimitzu et al., describes a cutting device having a blade with a plurality of triangular shaped cutting edges. This cutter design is comprised of a reciprocating bar which serves as the power source. Said power source is connected to the cutting mechanism by a complex solenoid operated interposing linkage having numerous wear points. To start the cutting cycle, the interposer is retracted by the solenoid. A linkage located at the power source end of a pivoted blade drive arm rotates into the path of the oscillating bar and causes the blade drive arm to pivot in the cutting direction while pushing the cutting blade forward. To retract the blade, the solenoid interposer is released and springs retract the blade to its non-operating position. This design has weaknesses in that it has a high degree of mechanical complexity, resulting in many wear points, significant assembly labor, poor maintainability, and is not positively retracted thereby making it prone to jamming. Additionally, it is difficult to align the slit in the print media support with the blade as they are on opposite sides of the mechanism. This promotes poor cutting, blade wear, and a propensity to jam.

U.S. Pat. No. 4,544,293, invented by Dean H. Cranston et al., illustrates a matrix printing mechanism with an integral scissors style cutting blade. The printhead is longitudinally driven across the paper by a barrel cam rotated in its primary direction by a D.C. motor. The cutting mechanism is driven by the printhead carriage cam shaft when rotated in its secondary direction. The cutting mechanism is coupled to the drive gear train through a one-way clutch. When the cam is rotated in the secondary direction the one-way clutch engages a gear with a pin which operates in a slot on a pivoted lever. As this gear rotates, it rides in the slot and pivots the blade actuating arm which in turn pivotally actuates the scissors-like pair of cutting blades. Scissors type blades require very long strokes and high cutting forces to complete the cutting cycle. Additionally, this type of blade configuration has a propensity to separate at the free end of the moving blade, thereby causing the paper to roll between the blades and jam the printer. This condition becomes decidedly worse as the edges of the blades wear. The Blade Drive gear is a sector gear so that the possibility of over-travel of the blade can be eliminated. However, if such over-driving were to occur, the last meshing teeth would likely be damaged by the ensuing skipping action. This design as well as the Shimitzu patent requires a spring return and as previously stated could be prone to become jammed closed, thereby assuring paper feed jamming. Additionally, the motor must be run in the opposing direction to facilitate the blade return to the home position. This design invokes a severe printing throughput penalty as the printhead is moved away from its home reference position during the cutting cycle. Also, using the cam in the manner stated precludes any implementation of intelligent printing. An additional drawback is that if the user wishes the output to be incompletely severed, this condition can only occur at one point at the open end of the blades. This may be undesirable to the user.

U.S. Pat. No. 4,491,046, invented by Hiroshi Hosogaya, teaches the design of a scissors action cutter similar to the Cranston patent and, additional provides a protection mechanism against blade damage from hard objects. The drive arm is driven by a cam and uses a return spring to bring the moveable blade to the home position. The pivot of the blade is constructed as a "U" shape and the blade is spring biased to keep the "U" pivot in contact with the pivot pin fixed in the stationary blade support. If a hard object obstructs the motion of the blades, the pivot separates from the pivot pin to prevent blade damage. Additionally, the design improves on the Cranston design in that it provides a loading force to keep the blades together at the open end.

THE INVENTION OBJECTS

Several objects and advantages of the present invention include:

a. Providing a cutting mechanism for an electronic printing device driven from the printer paper feed drive source.

b. Providing a media cutting mechanism that passively decouples from the paper feed drive of the electronic printing device when the cutter is operated.

c. Providing a cutting mechanism for an electronic printing device having an easily changeable blade.

d. Providing a cutting mechanism for an electronic printing device having a positive home return means.

e. Provide a cutting mechanism for an electronic printing device with few wear points and high reliability.

A further object of the invention is to provide a cutting mechanism for an electronic printing device economically designed for low cost manufacture.

It is another object of the invention to provide a cutter easily integrated with a variety of printing technologies such as direct thermal, thermal transfer, impact dot matrix, and ink jet.

Additional objects will be obvious to those skilled in the art from the drawings and detailed description which follows.

DRAWINGS

SUMMARY

The invention herein described is for a paper cutter used with an electronic printer. The attached printer may utilize but is not limited to thermal, thermal transfer, impact dot matrix, and ink jet technologies. The cutting mechanism derives its power from the drive source operating the paper feed mechanism of the printer. The printer driving the cutter mechanism has a one-way clutch coupled to the paper feed drive shaft which locks on to the shaft when feeding print media in the forward direction and over runs when the paper feed drive source rotates opposed to the print media driving direction. The second one-way clutch is coupled to the cutter drive shaft and positively engages the cutter mechanism when the paper feed drive is operated in the reverse non-feeding direction. It over runs when print media is being fed. The cutter home position is sensed by an optical sensor and signals the control electronics that the cutting cycle has been completed. The blade is easily removable for replacement.

DETAILED DESCRIPTION OF THE BEST MODE

The following detailed description illustrates the invention by way of example, not by way of limitation of the principles of the invention. The description will clearly enable one skilled in the art to make and use the invention. It describes several embodiments, variations, and adaptations including what I believe to be the best mode.

Figure 2:
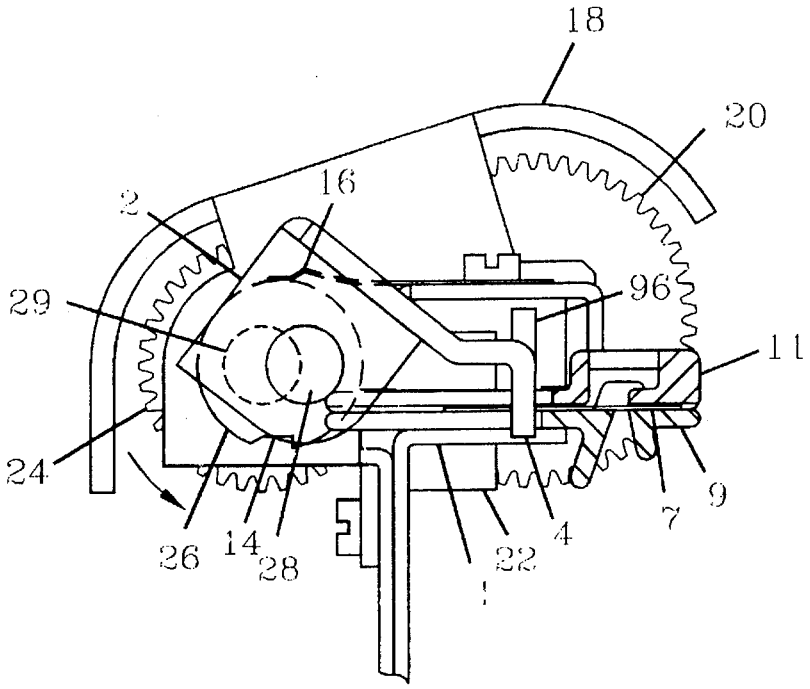
FIG. 2 is a Side Cross Section showing the general cutter arrangement with the cutting blade in the cut completion position.
Figure 1:
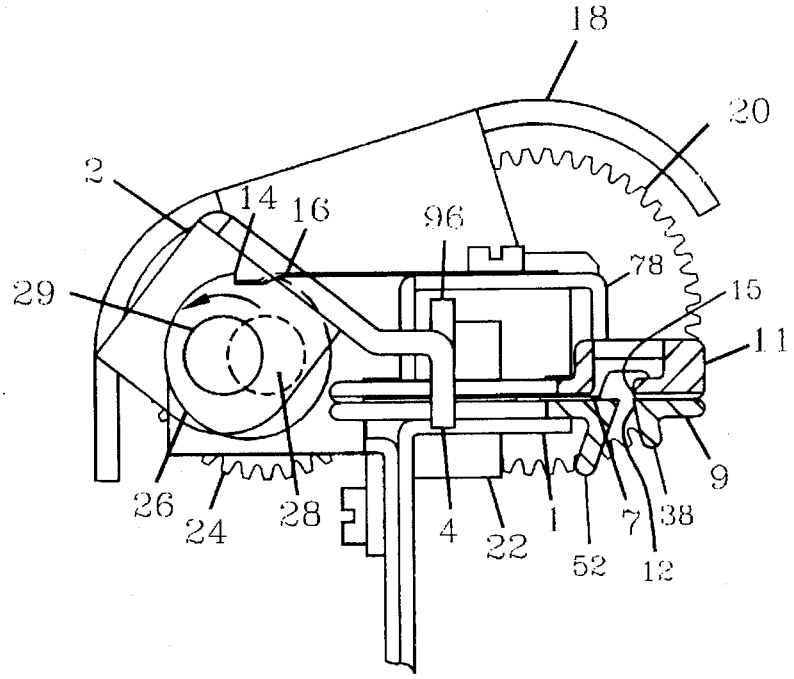
FIG. 1 is a Side Cross Section showing the general cutter arrangement with the cutting blade in the home position.
Figure 4:
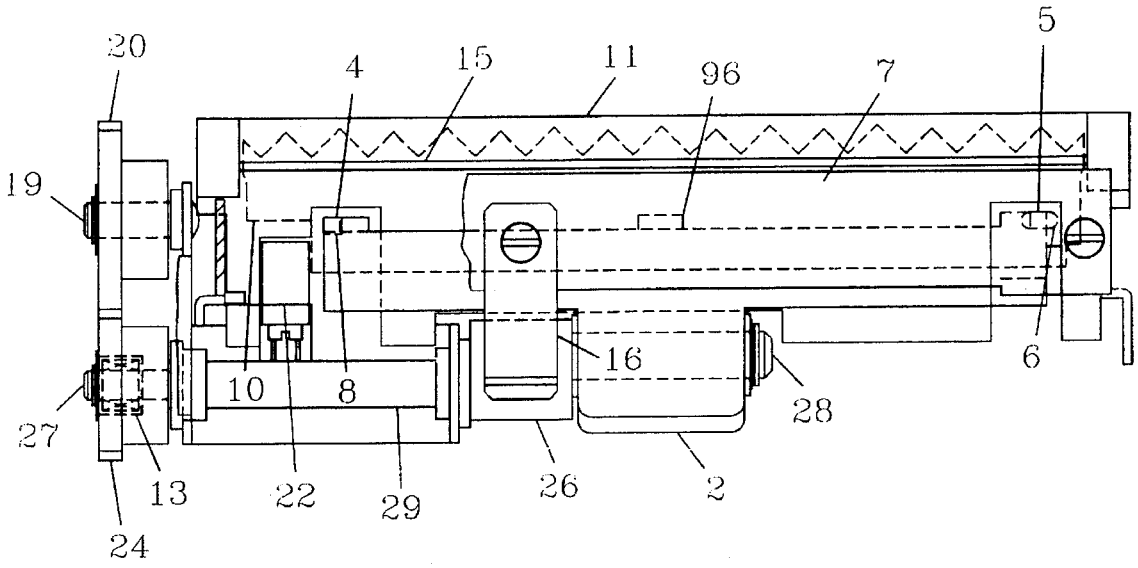
FIG. 4 is a Top View of the Cutting Mechanism showing the blade in the closed position.
Figure 3:
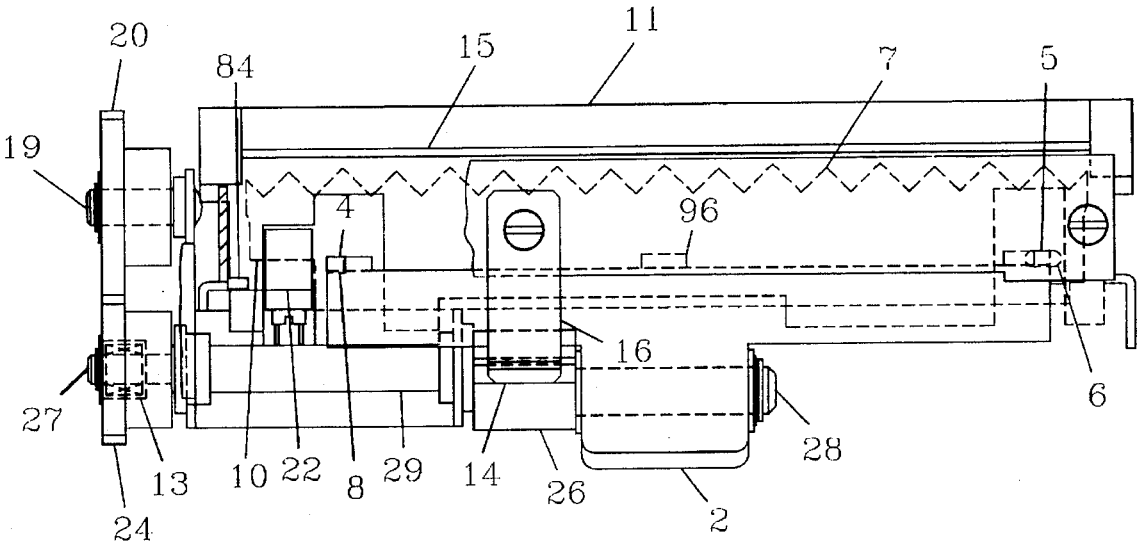
FIG. 3 is a Top View of the Cutting Mechanism showing the blade in the open position.

The preferred embodiment of the Paper Cutting Mechanism is operated by the reverse motion of the Paper Feed Mechanism of an electronic printing device and is shown in FIGS. 1 through 8. In FIG. 1 the cutting mechanism is generally referred to by numeral 1 and is shown with the cutting blade 7 in the open or retracted position thereby allowing print media to freely enter and to be forward fed through the cutting entrance guides formed by 38 and 52 by the paper feed mechanism of the attached printer mechanism. The cutting blade 7 is guided between an upper cutter blade guide 11 and a lower cutter blade guide 9. The cutting blade is fabricated from thin wear resistant sheet metal and is approximately 0.3 millimeters thick. It has a beveled forward cutting edge 82, shown in FIG. 8, and has a plurality of cutting edges as shown in FIGS. 3 and 4. The upper blade guide has a recess shown in FIG. 8 and defined by edges 101 and 103 and surface 102 in which the blade slideably moves toward and away from the forward edges of the print media slot as defined by 15 and 12 respectively in the upper and lower cutter blade guides. Said recess is approximately 0.5 millimeters deep. It will be recognized by those skilled in the an that other blade thickness and recess depths are possible and that the blade recess could reside in the lower cutter blade guide or have an independent spacer between the two guides. In the preferred embodiment the upper and lower guides are fabricated from anodized aluminum extrusions. It will also be recognized that other materials and fabrications are possible such as steel guides and separate formed paper entrance guides.

As previously stated FIG. 1 depicts the present invention with the Cutting Blade 7 in the open or home position. The home position is detected by a sensor 22. Said sensor is triggered by the Cutting blade or in the alternative a flag on the pusher bar when the Cutting Blade is in the rearward Home position. Said sensor in the preferred embodiment is a electo-optical transmissive device and is triggered by interrupting the optical path. It is generally available from numerous sources. An alternative sensor device would be a Hall Effect device which senses the change in magnetic field as the steel blade interrupts and shunts the magnetic field, much in the same way as the blade interrupts the light beam of the electro-optical transmissive device. Said sensor signals the control electronics that the cutter blade is in the home position.

The cutting blade motion is imparted by a pusher bar 2 having a pair of tangs 4 and 5 which are inserted respectively in blade hole 8 and blade slot 6 shown in FIGS. 3 and 4. Said pusher bar is fabricated from a wear resistant material to prevent wear at the interface of the tangs of the pusher bar and the hole and slot in the blade. In the preferred embodiment the pusher bar is formed sheet metal but as will be recognized, other similar arrangements can be arrived at using singular or multiple parts. Said pusher bar 2 has an engagement tab 96 opposed to the tangs and upperly guided by a keeper 78. Said Keeper performs multiple functions. It keeps the tangs 4 and 5 of the pusher within the hole and slot 8 and 6 of the blade, retains the upper and lower cutter guides within the cutter structure by inserting an integral retention tab in the slots 84 of the upper and lower blade guides, provides a mounting surface for anti-backup spring 16, and allows easy removal of the blade if it needs to be change due to went or damage. The pusher bar motion is imparted by an eccentricly driven crank mechanism. Said eccentric crank mechanism is defined by a crank 26, crank pin 29, and cutter drive rod 28. A bearing is located within the structure of the pusher bar 2 at the location defined by the crank pin 29. The crank 26 has a slot 14 for receiving the a first end of the anti-backup spring 16 and has an eccentricity determined by the amount of blade stroke desired to cut the print media. A second end of said anti-backup spring is affixed to the keeper 78. In the home position the tip of said anti-backup spring rests in the slot of the crank, thereby preventing the crank from rotating in the clockwise direction when in the home position as shown in FIG. 1. Said slot having a registration first edge orthogonal lo the spring and a second opposing sloped exit edge for camming said anti-backup spring from said slot 14 as the crank rotates in a counter-clockwise direction.

To cut the print media, said crank mechanism rotates in a counter-clockwise fashion about the cutter drive rod 28. The rotation of the crank mechanism translates the rotary motion into a sliding motion by pushing the blade engaged tangs 4 and 5 of the pusher bar forward. The print media is restrained by the forward edges of the print media slot as defined by 15 and 12 respectively in the upper and lower blade cutter guides. The blade moves forward toward the position defined by FIGS. 2 and 4 and the blade 7 is forced through the print media 30 thereby severing same. The crank mechanism continues rotation pulling the blade backward in a positive fashion until the sensor interposing edge 10 of the blade 7 interrupts the optical path of the photo-optical transmissive device 22. At the home position the tip of the anti-backup spring 16 drops into the recess 14 of the eccentric crank 26 and is positionally restrained until the next cutting cycle. This detent serves the purpose of allowing the cutter mechanism to be opened and maintaining its position for re-engagement with the printer mechanism. The print media is stripped from the blade by the rear print media entrance guide 52.

Figure 5:
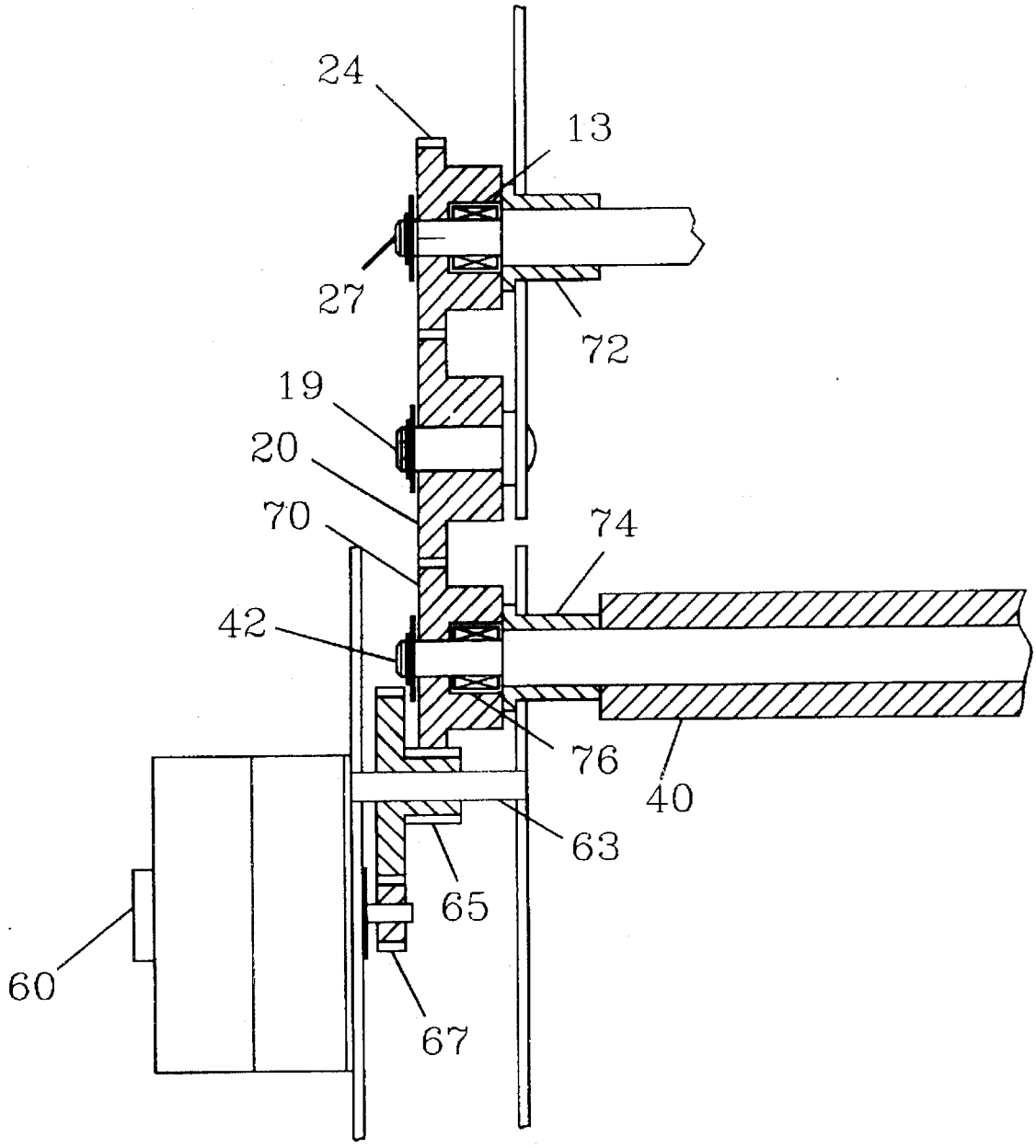
FIG. 5 is a cross Section showing the general gear drive arrangement with clutches.
Figure 6:
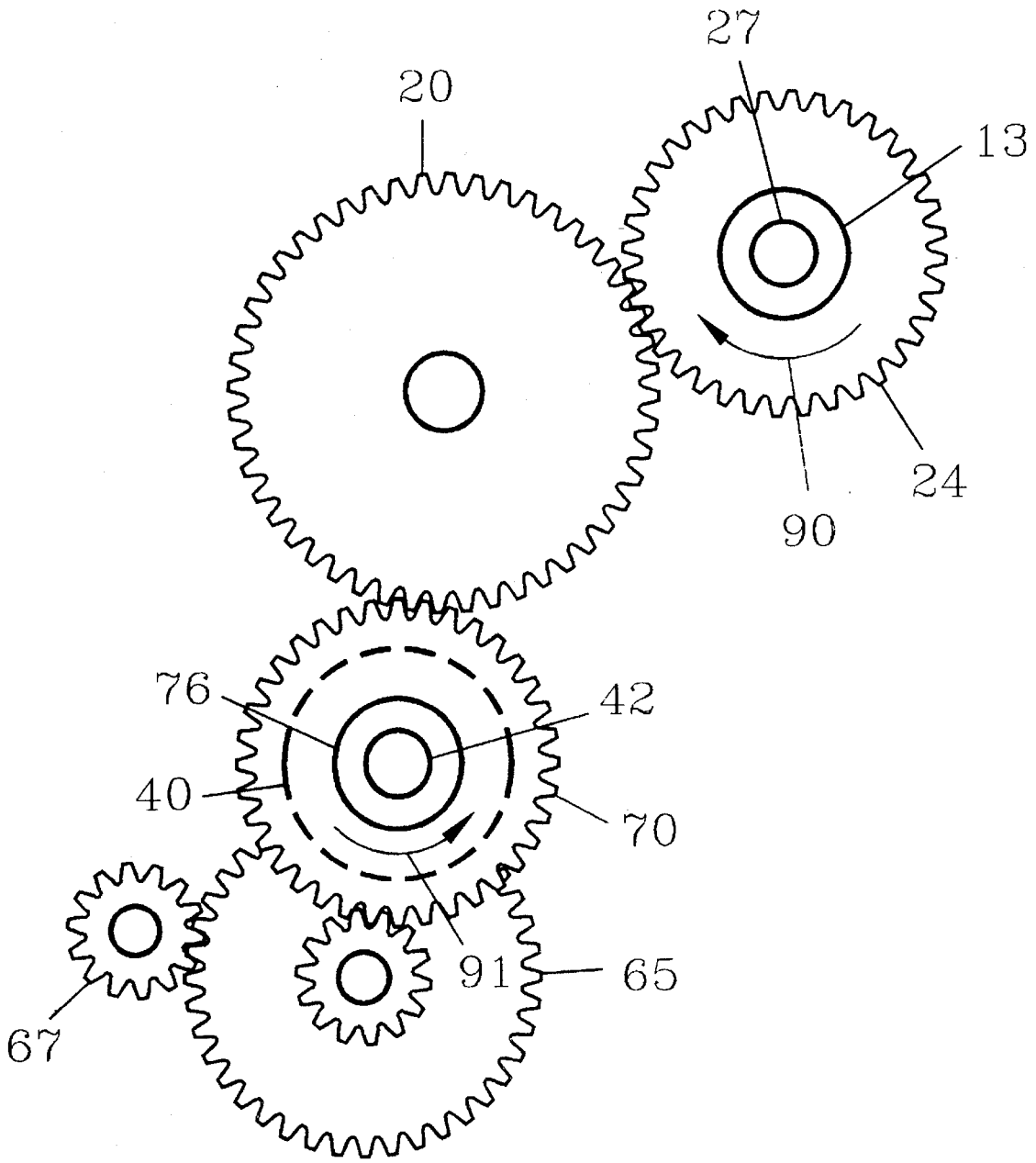
FIG. 6 is a Plan View of the general gear drive arrangement with clutches.

FIGS. 5 and 6 show the operation and function of the two one-way clutches 13 and 76. In FIGS. 5 and 6, one-way clutch 76 is installed with the outer race affixed to gear 70 and positively engaging the paper feed drive shaft 42 when rotating in the print media feeding direction 91. Said paper feed drive shaft 42 is driveably affixed to Paper Feed Drive Roll 40 and rotationally supported by the mechanism frame through bearing 74. The clutch engaging rollers couple the paper feed drive gear 70 to the paper feed drive shaft 42 when the paper feed drive gear 70 and the motor drive gear 67 rotate in the paper feeding direction. Said motor drive gear 67 is affixed to the drive shaft of Drive motor 60. Said motor drive gear 67 is reduceably coupled by cluster gear 65 rotatably afixed to the mechanism by shaft 63. One-way clutch 13 is installed with the outer race affixed to cutter drive gear 24 and positively engaging the cutter drive shaft 27 when rotating in the media cutting direction 90. Said cutter drive shaft is rotatably frame supported by bearing 72. Said cutter drive gear 24 is coupled to the paper feed drive gear 70 by idler gear 20 rotatably afixed to the mechanism by idler shaft 19. The cutter drive gear clutch over runs when the motor turns in the paper feeding direction, thereby allowing the cutter to remain at the home position. When the motor drive gear 67 rotates in the paper cutting direction the clutch engaging paper feed drive gear 70 decouples from the paper feed drive shaft 42, thereby stopping the print media motion, and clutch engaging cutter drive gear rotates in paper cutting direction, coupling to and positively engaging the cutter drive shaft 27. Said cutter drive gear 24 and idler gear 20 are optionally protected by guard 18.

Figure 7:
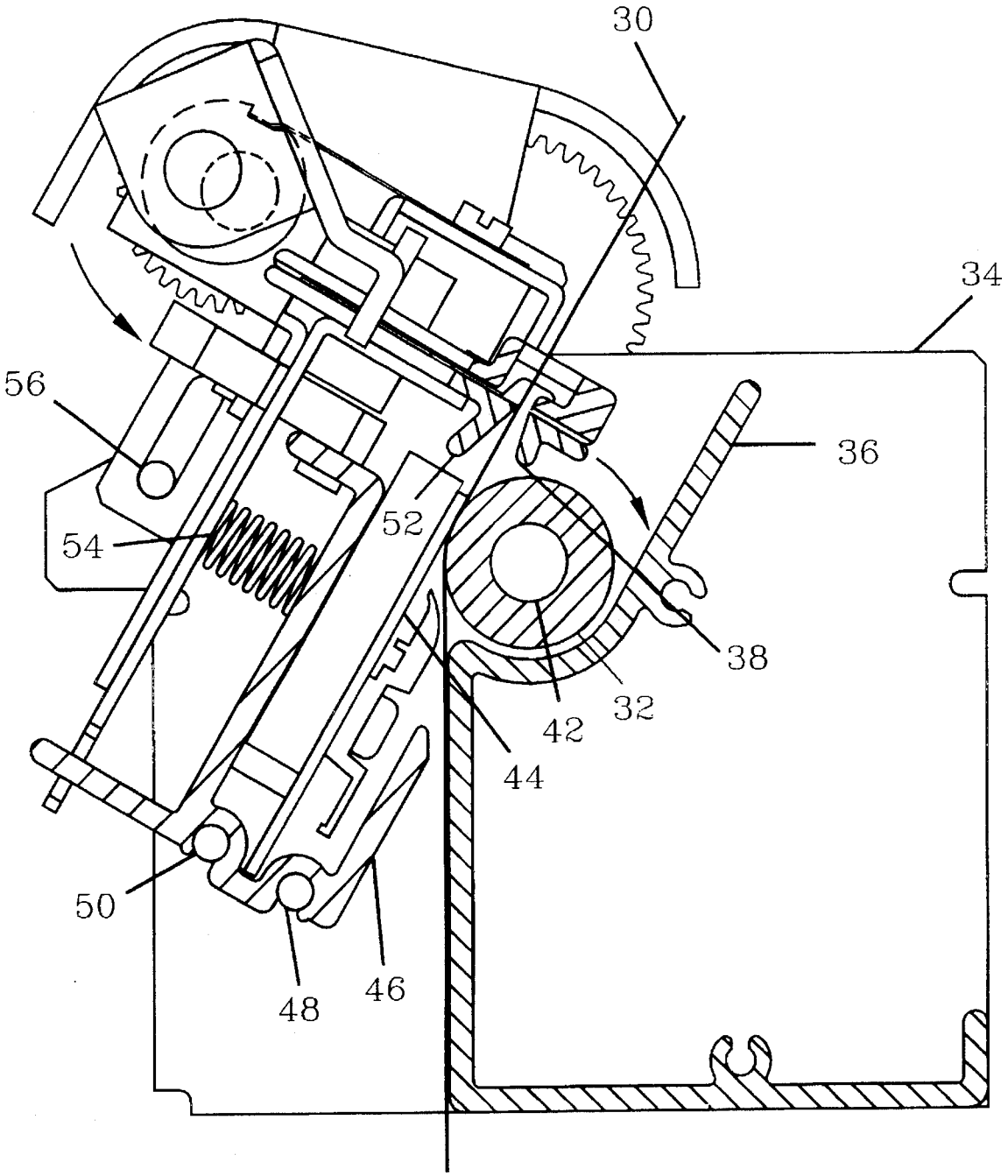
FIG. 7 is a Side Cross Section showing the general cutter arrangement mounted on a thermal printer and showing the paper path through the printer with the Cutting Mechanism in the open position.
Figure 8:
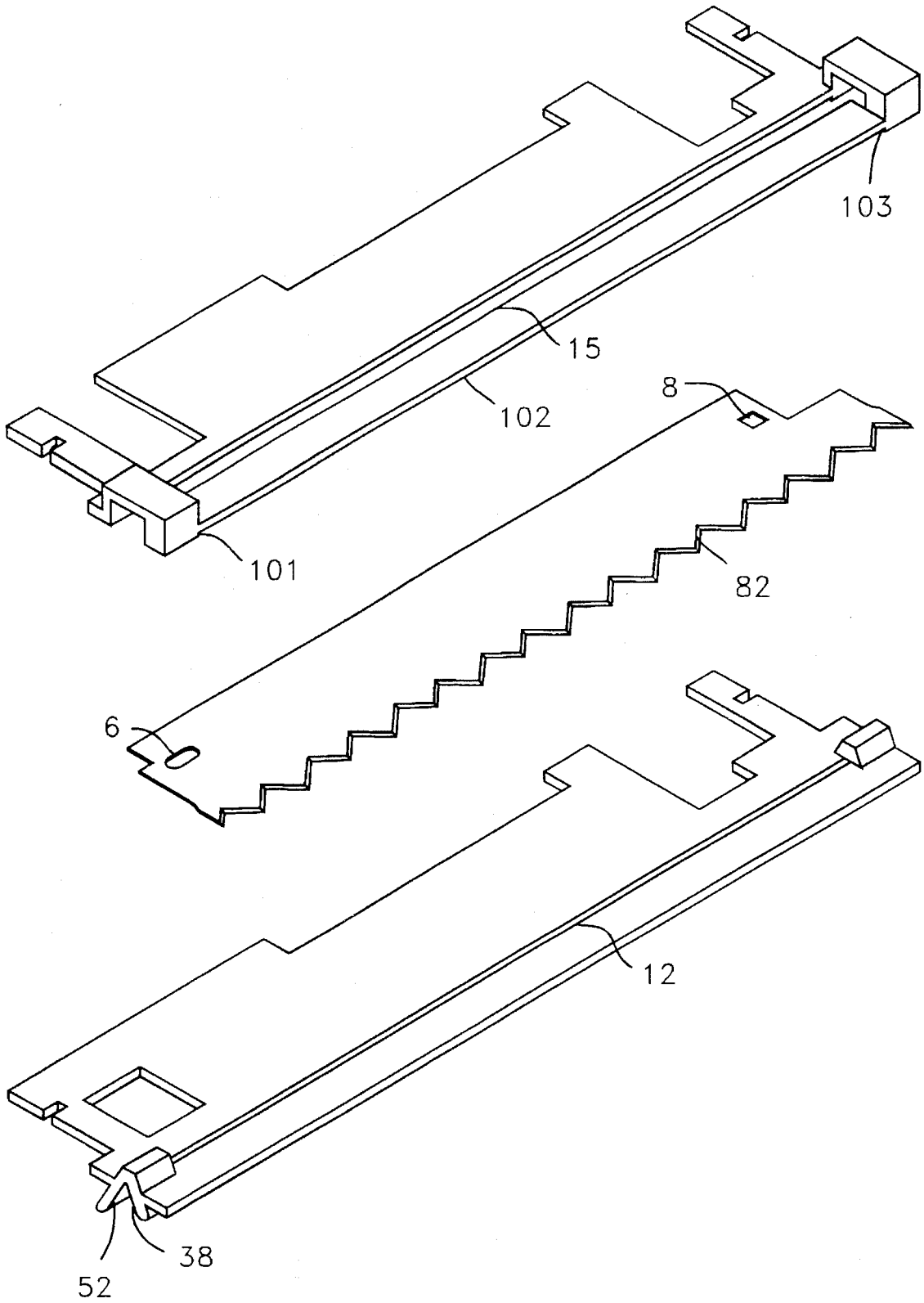
FIG. 8 is an Exploded view of the Media Cutting Blade with Upper and Lower Media Cutting Blade Guide.

FIG. 7 shows the present invention mounted to a typical thermal printer. The print media 30 enters the printing device through either the bottom entrance as defined by the head paper guide 46 and rear paper guide 36 or the top entrance as defined by the space between the rear paper guide 36 and the paper feed drive roll 32. Said rear paper guide 36 and head paper guide 46 are pivotably and guideably afixed to the print mechanism side plate 34 by pins 48 and 50 and latchably attached by latch rod 56. The print media is squeezed between the raster line printhead 44 and the paper feed drive roll 32 by spring and enters the cutter paper guide defined by 38 and 52. Print media advances through the cutting slot in the cutter as previously described and is cut when forward feeding of the print media ceases and reverse feeding ensues.

It will be obvious to those skilled in the art that the thermal printing mechanism could be substituted for by an impact dot matrix, thermal, transfer, or ink jet printing device and that coupling the cutter to the paper feed mechanism provides a universal cutter mechanism for those machines having a drive shaft driven paper feed mechanism which can be decoupled from the drive source using a one-way clutch.

As will be obvious to persons skilled in the art, various modifications, adaptations, and variations of the specific disclosure can be made without departing from the teaching of the invention.

Having thus described this invention, what is claimed is:

1. A media cutting device of an electronic printing device comprising:

a media cutting blade;

said media cutting blade having a thickness, a plurality of beveled media cutting edges, a pusher bar receiving hole proximate one edge orthogonal to said beveled media cutting edges and a slot proximate a second orthogonal edge to said media beveled cutting edges;

an upper media cutting blade guide means having a blade receiving recess with a depth exceeding the thickness of said media cutting blade and a media receiving slot orthogonal to said blade receiving recess;

a lower media cutting blade guide means having a media receiving slot orthogonal to said blade receiving recess;

said media receiving slot having a forward print media restraining edge;

said media cutting blade slideably located in said recess of said upper cutting blade guide means and sandwiched between said upper blade guide means and said lower blade guide means;

a pusher bar having a pair of media cutting blade engagement means, an opposed guiding means, and a crank pin engaging pivot located opposite and parallel to the plane formed by said media cutting blade engagement means;

said opposed guiding means being a part of said pusher bar and limiting the slidable clearance between said media cutting blade and said upper media cutting blade guide and the lower media cutting blade guide;

a keeper having an opposed guiding means restraining surface;

said media cutting blade engagement means insertably engaging said media cutting blade;

said opposed guiding means slideably restrained by said keeper;

a crank assembly having a crank pin at a first end pivotally connected to said crank pin engaging pivot, an eccentric crank having a stroke regulating eccentricity, an anti-backup means, and an eccentric drive shaft at a second end;

said eccentric drive shaft being engaged by a one-way clutch to a media cutting device drive means in a cutting direction and decoupled from the media cutting device drive means in a paper feeding direction;

said electronic printing device having a one-way clutch located in a paper feed mechanism and being coupled to a paper feed drive when in a paper feeding direction and decoupled from the paper feed mechanism when in the cutting direction; and a media cutting blade position sensing means;

said media cutting blade position sensing means feeding an electronic signal to an electronic control means.

2. The media cutting device according to claim 1 wherein the upper media cutting blade guide and the lower media cutting blade guide have a pair of position locking slots at both ends orthogonal and opposite from the media slot; and said media upper cutting blade guide and said media lower cutting blade guide being held in place by tabs on said keeper.

3. The media cutting device according to claim 2 wherein the lower media cutting blade guide is an extrusion and has an integral pair of media receiving guides straddling both sides of the media receiving slot; and said upper media cutting blade guide is an extrusion.

4. The media cutting device according to claim 3 wherein said anti-backup means is a flat spring having a first end anchored to the keeper and a second opposing free end indexing and detented into a slot in the circumference of the eccentric crank and parallel to the crank pin; said slot having a spring engaging edge in the paper feeding direction, a detent well, and an opposing ramp edge disengaging said flat spring in the cutting direction.

5. The media cutting device according to claim 4 wherein the pusher bar is a formed sheet metal means.

6. The media cutting device according to claim 5 wherein said media cutting blade had an integral media cutting blade position sensing means interrupting means.

7. The media cutting device according to claim 6 wherein the media cutting blade position sensing means in an electro-optical sensor.

8. The media cutting device according to claim 6 wherein the media cutting blade position sensing means is a Hall Effect sensor.

9. The media cutting device of an electronic printing device according to claim 1 wherein the electronic printing device is a thermal printer with a raster line head.

10. The media cutting device of an electronic printing device according to claim 1 wherein the electronic printing device is a serial impact dot matrix printer.

11. The media cutting device of an electronic printing device according to claim 1 wherein the electronic printing device is an ink jet printer.

* * * * *